US005417616A

United States Patent [19]

Widrick

[11] Patent Number: 5,417,616

[45] Date of Patent: May 23, 1995

[54] SPRING BIASED BUMPER BOWLING SYSTEM

[75] Inventor: Kent L. Widrick, Castorland, N.Y.

[73] Assignee: AMF Bowling, Inc., Mechanicsville, Va.

[21] Appl. No.: 271,724

[22] Filed: Jul. 7, 1994

[51] Int. Cl.[6] ..... A63D 5/00

[52] U.S. Cl. ..... 473/113; 473/55; 16/291

[58] Field of Search ..... 473/55, 113; 16/281, 16/286, 289, 291, 293

[56] References Cited

U.S. PATENT DOCUMENTS

| | | | |
|---|---|---|---|
| 2,117,148 | 5/1938 | Clark | 16/281 |
| 3,401,933 | 9/1968 | Conklin et al. | 473/113 |
| 4,690,468 | 9/1987 | Lau | 16/491 |
| 4,862,555 | 9/1989 | Grass | 16/491 |
| 4,900,024 | 2/1990 | Chandler et al. . | |
| 5,181,716 | 1/1993 | Stephens | 473/113 |
| 5,304,097 | 4/1994 | Duff | 473/113 |
| 5,322,476 | 6/1994 | Wortman | 473/113 |

*Primary Examiner*—Vincent Millin
*Assistant Examiner*—William M. Pierce
*Attorney, Agent, or Firm*—Bacon & Thomas

[57] ABSTRACT

A bowling alley bumper system which can be used for conventional bowling and for bumper bowling is disclosed. The bowling alley bumper system includes a pair of gutters having longitudinally extending portions and spring biased extending and retracting mechanisms for moving those portions (bumpers) into an extended position to prevent a bowling ball from falling into a gutter and downwardly into a retracted position which allows bowling balls to fall into and roll along one of the gutters. In one embodiment, the portion is moved upwardly or downwardly along an arc in an XZ plane with little or no lateral movement, and the spring biased mechanism retains the bumpers in their extended and retracted positions. The spring biased mechanism also causes the bumpers to "pop-up" when moved out of the recessed position.

6 Claims, 4 Drawing Sheets

FIG. 5
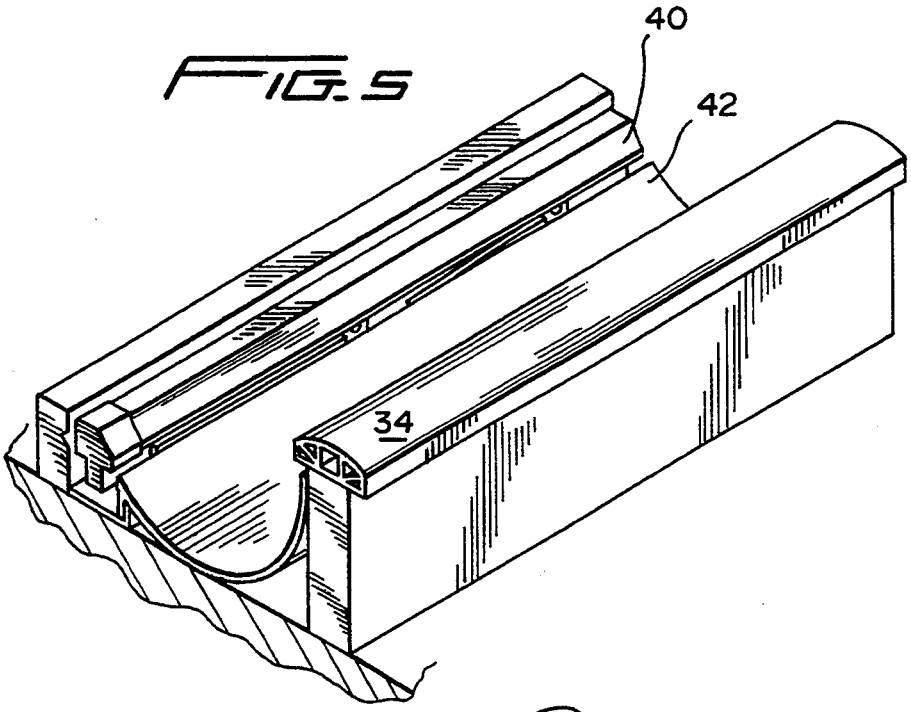
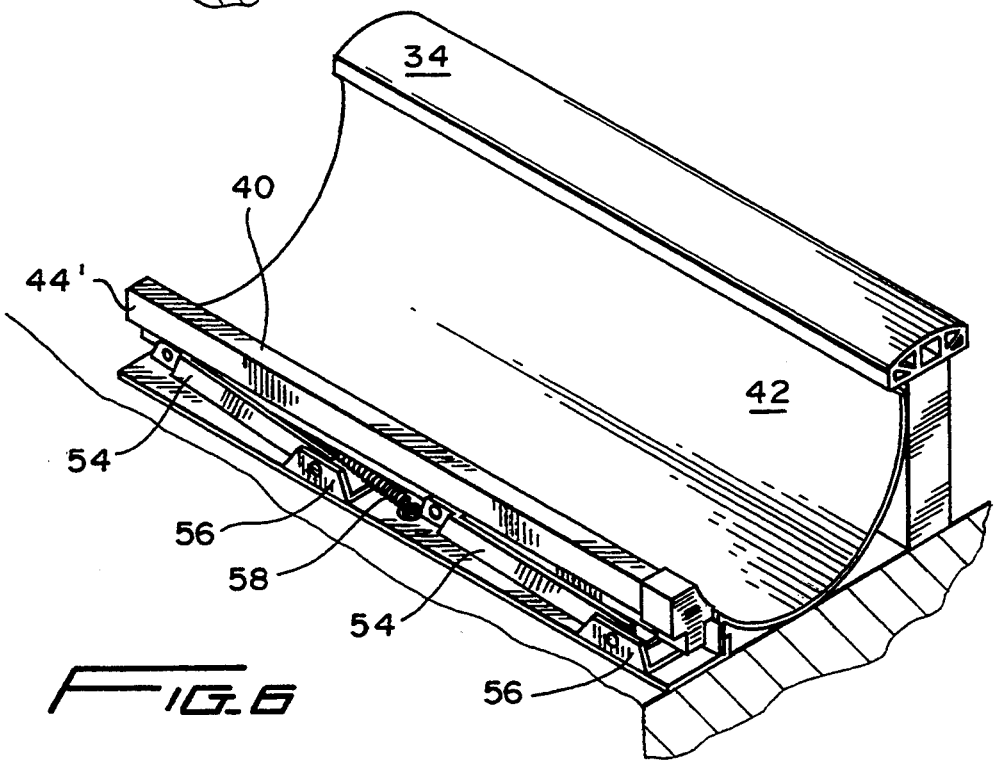
FIG. 6

SPRING BIASED BUMPER BOWLING SYSTEM

FIELD OF THE INVENTION

This invention relates to a bowling alley bumper system and, more particularly, to a bowling alley bumper system wherein the bumper such as a gutter or portion thereof is spring biased toward an extended portion which prevents a bowling ball from falling into the gutter.

BACKGROUND OF THE INVENTION

Bowling alley bumper systems have been available since at least as early as 1965. Such systems were designed to be used by children and/or the physically handicapped as well as others who lack the physical coordination or strength to bowl, i.e., project a majority of the balls over the length of the alley without ending up in one of the gutters. Early systems require relatively difficult steps to set up a lane or lanes for so-called "bumper" bowling. For this reason, a number of bowling alley operating personnel were reluctant to promote "bumper" bowling or to encourage children or the handicapped to use the lanes.

One approach to overcome the aforementioned problem is disclosed in U.S. Pat. No. 3,401,933 to Conklin et al. That patent discloses a convertible bowling lane having a gutter with a ball receiving surface on one side and a ball deflecting surface on the opposite side and means for moving the gutter between a ball receiving position and a ball deflecting position. As disclosed therein, the gutter is pivotally mounted on a support member which is disposed on the opposite side of the gutter from the bowling lane. The system does present the appearance of a normal bowling alley when in its recessed position, but is relatively complex and somewhat expensive to install.

More recently, a bowling alley bumper mechanism such as the one disclosed in U.S. Pat. No. 4,900,024, overcame many of the earlier problems. In such systems, an elongated bumper is mounted alongside and parallel to each alley gutter. The systems also include movable supports that permit the extension of the bumpers to guard the gutters when guarding is desired and retraction of the bumpers to expose the gutters when normal alley operation is desired. The Chandler et al. system is less costly and less complex than the Conklin et al. system, but extends upwardly above the level of the alley even in its recessed position. It also presents an obstacle to walking along the normal capping and may lead to individuals walking on the alley.

An improvement to the Chandler et al. system is disclosed in the copending application of C. Dennis Lord, Ser. No. 07/758,003, filed on Sep. 12, 1991, and assigned to the same assignee as the present application. As shown therein, the Chandler et al. system may be constructed to present a more pleasing appearance, but still results in an elevated portion adjacent to the alley which may be objectionable to some bowlers and/or alley owners.

It is now believed that the availability of the Chandler et al. type systems, coupled with a change in demographics and business pressures, will encourage bowling alley operators to put more emphasis on bumper bowling to encourage children to learn to bowl, attract families and provide a challenging game for the physically handicapped. For this reason, it is presently believed that there is a demand for an improved bowling alley bumper system which provides a more normal appearance when not in use, is relatively inexpensive to manufacture, easy to install and remove, protects the mechanism from damage and, at the same time, provides ready access to the rear of the lanes without walking on the lanes.

One system for providing such advantages is disclosed by U.S. patent of Stephens, U.S. Pat. No. 5,181,716, which is assigned to the same assignee as the present invention and which is incorporated herein in its entirety by reference. In that system, the bumper system utilizes a portion of the gutter to prevent a bowling ball from falling into the gutter. And, in a preferred embodiment of the system, a portion of the gutter adjacent to the lane is moved upwardly or downwardly along an arc in an XZ plane with little or no lateral movement along the Y axis.

It is now believed that there is a significant demand for an improved bumper system wherein the bumper is more easily extended and/or pops-up into position with a minimal effort by a bowler or bowling alley proprietor. It is further believed that a system in accordance with the present invention presents a pleasing appearance, is relatively inexpensive to manufacture, easy to install and service, is relatively durable and will require minimal maintenance when subjected to normal use.

BRIEF SUMMARY OF THE INVENTION

In essence, the present invention contemplates an improved bowling alley bumper system wherein the bowling alley can be used for conventional bowling and for bumper or carum bowling. The bowling alley has two sides and a longitudinally extending lane on an upper surface thereof. The alley also includes a foul line at one end thereof and a pin deck at its opposite end. A pair of elongated, concave gutters extend along each side of and in substantially abutting relationship to the alley between the ends thereof for receiving a bowling ball which is directed toward the edge of the alley, i.e., which falls off of the lane. The bumper system also includes spring biased movable bumper means such as an elongated portion of each gutter to prevent a bowling ball from falling into one of the gutters. For example, in one embodiment of the invention, each of the gutters define first and second separate longitudinally extending portions with each of the portions having a major axis which is parallel with the major axis of the gutters. Extending and retracting means are provided for moving the gutters or one of the portions in each of the gutters upwardly into an extended position to thereby prevent a bowling ball from falling into one of the gutters and downwardly into a retracted position which allows bowling balls to fall into and roll along one of the gutters. The spring biasing means holds the movable bumper means in its extended and retracted positions and biases the movable bumper into and toward its extended position when it is moved out of the retracted or recessed position.

In a preferred embodiment, a first portion of each of the gutters, i.e. , the portion adjacent to the alley, is moved upwardly or downwardly along an arc in an XZ plane with little or no lateral movement, i.e., little or no movement along its Y axis.

BRIEF DESCRIPTION OF THE DRAWINGS

FIG. 5 is a perspective view which shows the preferred embodiment of the invention with the bumper in a recessed position;

FIG. 6 is a second perspective view which shows the preferred embodiment of the invention.

DESCRIPTION OF THE PREFERRED EMBODIMENT

Figure 1:
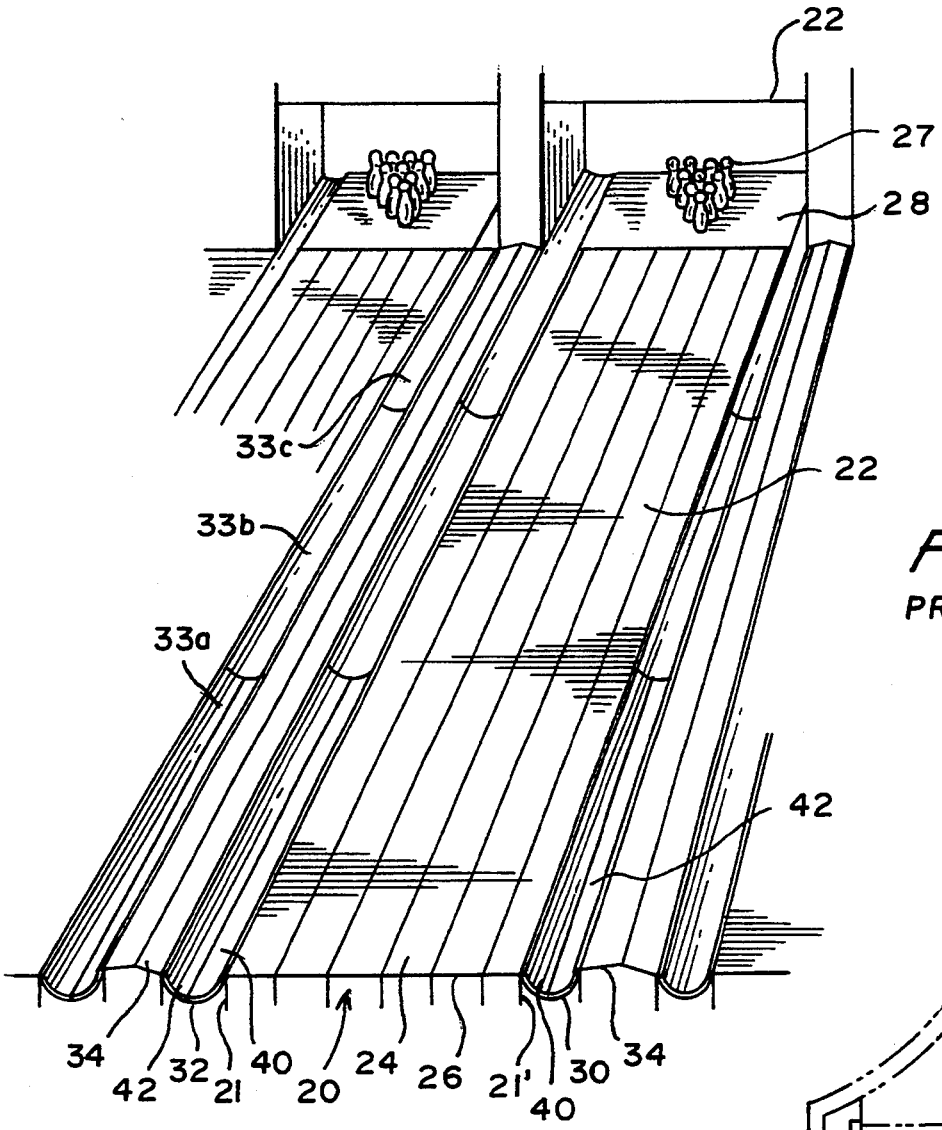
FIG. 1 PRIOR ART
FIG. 1 is a perspective view of a prior art bowling alley bumper system.

The invention will now be described in connection with the accompanying drawings wherein like reference numerals have been used to designate like parts.

As illustrated in FIG. 1, a bowling alley 10 typically includes a longitudinally extending lane 20 which defines a flat horizontal plane on an upper surface thereof and which is typically made up of a plurality of parallel abutting strips of wood 22, 24. The alley includes a foul line 26 which extends across the lane 20 and perpendicular to the longitudinal axis of the lane. The foul line 26 indicates that area beyond which a bowler may not pass in releasing a bowling ball during a game of bowling. A pin deck 28 is disposed at the opposite end of the lane 20 and is adapted to receive a plurality of bowling pins 27 thereon. As shown, the bowling alley is set with the pins in a customary triangular pattern with one pin, the head pin in front, a second row of two pins, a third row with three pins and a final of four pins.

A pair of longitudinally-extending gutters 30, 32 are disposed along the side of the lane 20 with one gutter on each side of lane 20 in a customary manner, i.e., adjacent to and in substantially abutting relationship with the lane. The gutters 30, 32 are adapted to receive any balls that are bowled toward one side of the lane and to direct any misdirected balls to the end of the alley. Also illustrated are capping members 34 which separate the adjacent alleys or lanes.

Figure 2:
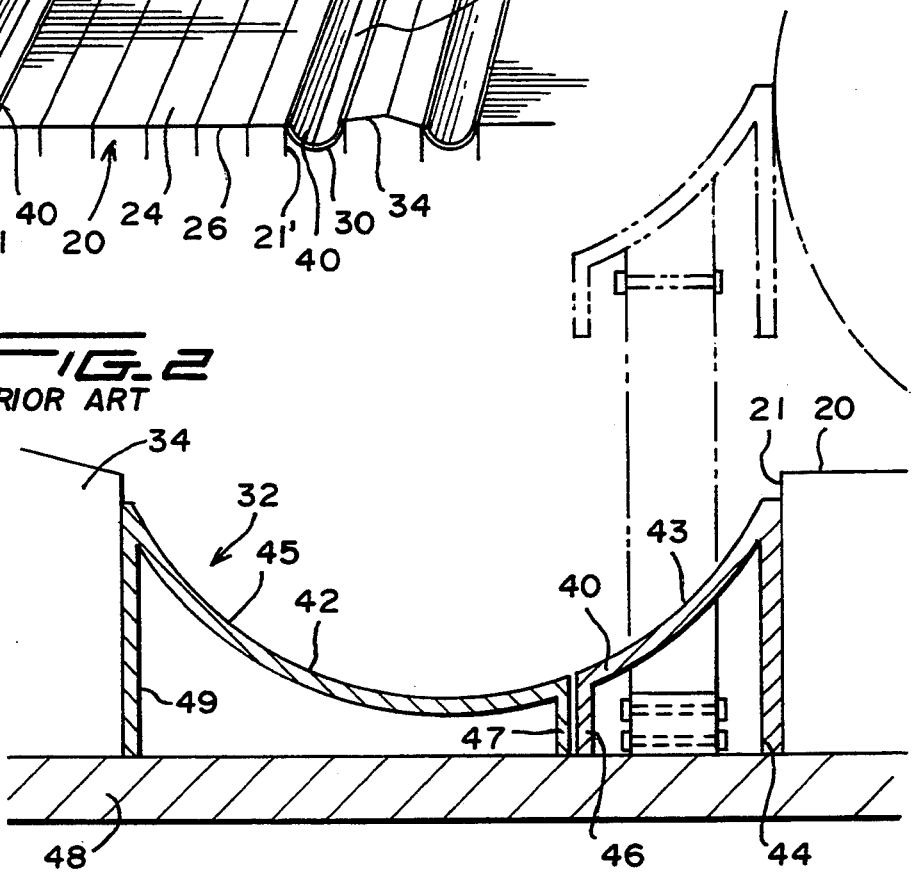
FIG. 2 PRIOR ART
FIG. 2 is an end view of a portion of the bowling alley bumper system shown in FIG. 1, but with the bumper system shown in its extended portion by broken lines.
Figure 3:
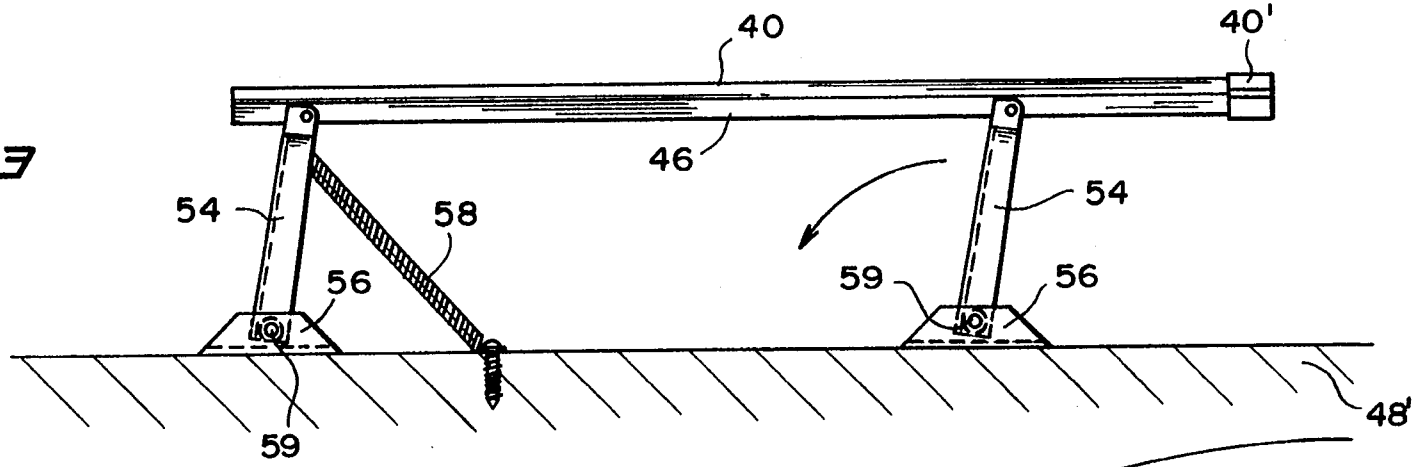
FIG. 3 is a side elevational view of a bowling alley bumper system in accordance with a preferred embodiment of the invention.

A mechanism for bumper bowling such as the one disclosed in the aforementioned Stephens patent is illustrated more clearly in FIG. 2. As illustrated therein, a bumper bowling system is incorporated in the bowling alley 10 which includes two sides 21, 21′ (see FIG. 1) and a longitudinally extending lane 20 on an upper surface thereof. In one embodiment of that invention, each of the gutters 30, 32 define first and second concave, longitudinally extending portions 40, 42. The first portion 40 defines an arc-shaped concave surface 43 which forms a part of the gutter 32 and forms about one-third of the gutter when viewed in cross section. The portion 40 also includes a pair of downwardly extending projections 44, 46 which are preferably parallel to one another. The projections 44, 46 support the portion 40 on a suitable base such as a plurality of cross members 48. The first projection 44 is adjacent to and abuts side 21 and is constructed and arranged to slide upwardly therealong. The projection 44 may also include a resilient bumper recessed thereon for engaging a bowling ball which is directed toward the bumper.

The second longitudinally extending portion 42 also defines an arc-shaped concave surface 45 which forms the outer two-thirds of gutter 32. The portion 45 also includes a pair of downwardly extending parallel projections 47, 49. The projections 47, 49 are fixed to the cross member 48 in a customary manner with a first of the projections 47 adjacent to and abutting projection 46. The second projection 49 is adjacent to and abutting capping member 34 which separates a pair of alleys.

For conventional bowling, the longitudinally extending portions 40 are positioned in the lower or retracted position shown in FIGS. 1 and 2. However, when it is desired to convert the lane to bumper bowling as defined more clearly in the aforementioned patents of Conklin et al. and Chandler et at., each of which is incorporated herein in its entirety by reference, the portion 40 is raised upwardly along an are in the XZ plane. The portion 40 is moved upwardly by means of a crank arm and a pair of swivel connecting elements to the position shown by the broken lines in FIG. 2. The swivel connecting elements are operatively connected to the bottom of portion 40 in a conventional manner.

In a preferred embodiment of the Stephens patent, the portion 40 is moved upwardly along an arc. This motion is in the XZ plane so that there is little or no lateral motion, i.e., along the Y axis.

While the aforementioned devices are considered satisfactory for the marketplace, it is presently believed that the market would prefer a "pop-up" feature wherein a slight movement with minimal effort on the longitudinal extension 40 causes the portion 40 to spring upward into its extended position. It should also be recognized that while the present invention is being described in connection with a Stephens type of system, it is equally applicable to other bumper systems wherein it is desirable to have a spring assisted mechanism.

As shown more clearly in FIGS. 3–7, the portion 40 may comprise a metal or plastic extrusion with an end cap 40′. The portion 40 also includes a downward projection 44′ (FIG. 4) which engages a bowling ball which is bowled toward it when in its extended or upper position. The second longitudinal extending portion 42 defines an arc-shaped concave surface and includes a downward extending projection 47. The downward extending projection 47 rests against an angle bracket 50 and is held rigidly in place by clamp 51 and screws 52 and 53.

Figure 4:
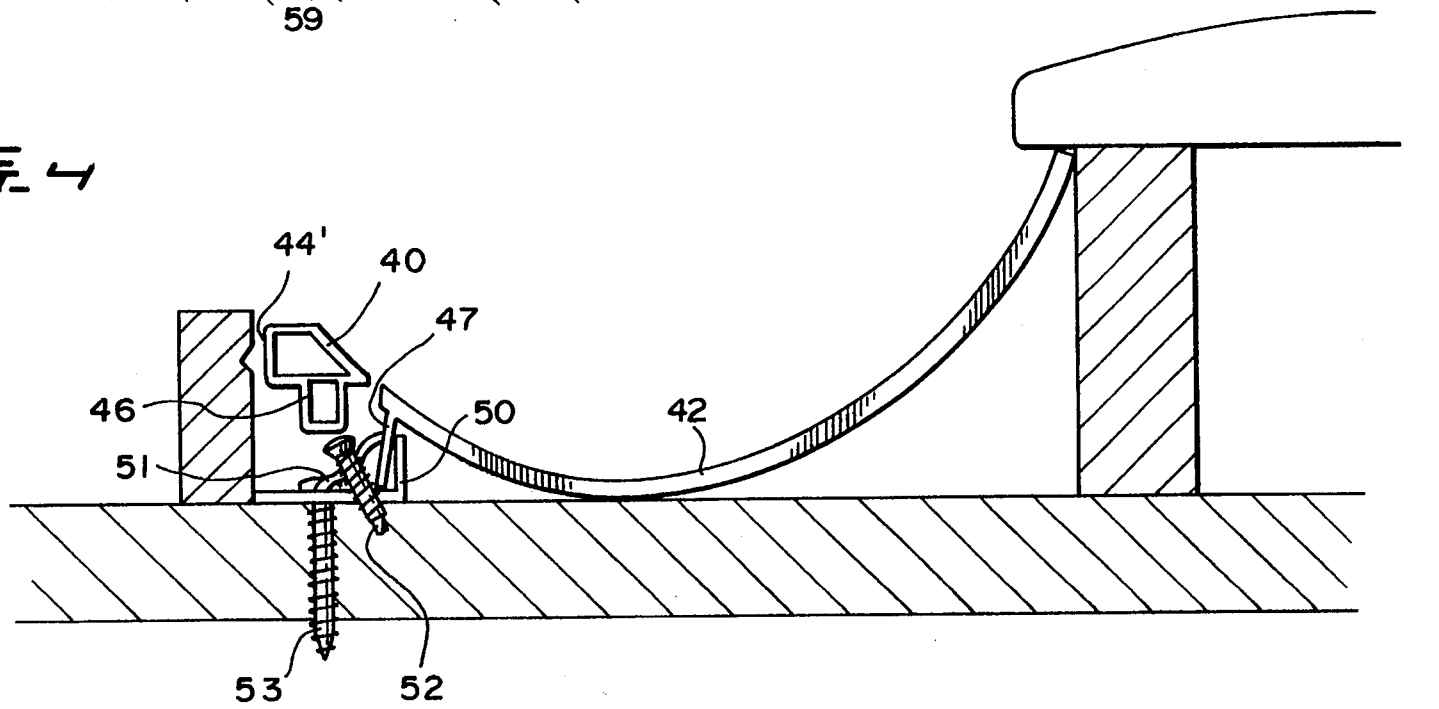
FIG. 4 is an end view of the bowling alley bumper system shown in FIG. 3, but shown without the spring biased elevation assembly.

The spring biasing means is shown more clearly in FIGS. 4–6. As shown therein, the portion 40 is moved upwardly into its extended position by means of a plurality of crank arms 54. The crank arms are pivotably mounted to mounting members 56 which are fixed to a suitable base such as the cross members 48 in a conventional manner. As shown in FIG. 4, a single coil spring 58 is attached at one end thereof to the base and at its opposite end to one of the crank arms 54. The spring 58 is preferably under sufficient tension when portion 40 is in its upper or extended position to maintain portion 40 in that position.

As portion 40 is moved rearwardly and downwardly in the direction of the arrow (FIG. 4), the tension on spring 58 is increased. Then, as portion 40 is put into its recessed or retracted position (see FIG. 6), the spring 58 is stretched across pivot pin 59 in an over-center arrangement i.e. with the opposite ends of the spring below the level of the pivot 59 while a center portion of the spring 58 is above pin 59. This over-center arrangement holds the portion 40 in its recessed position until it is lifted slightly out of its over-center condition which causes portion 40 to "pop-up" into its extended position as shown in FIG. 5.

Figure 7:
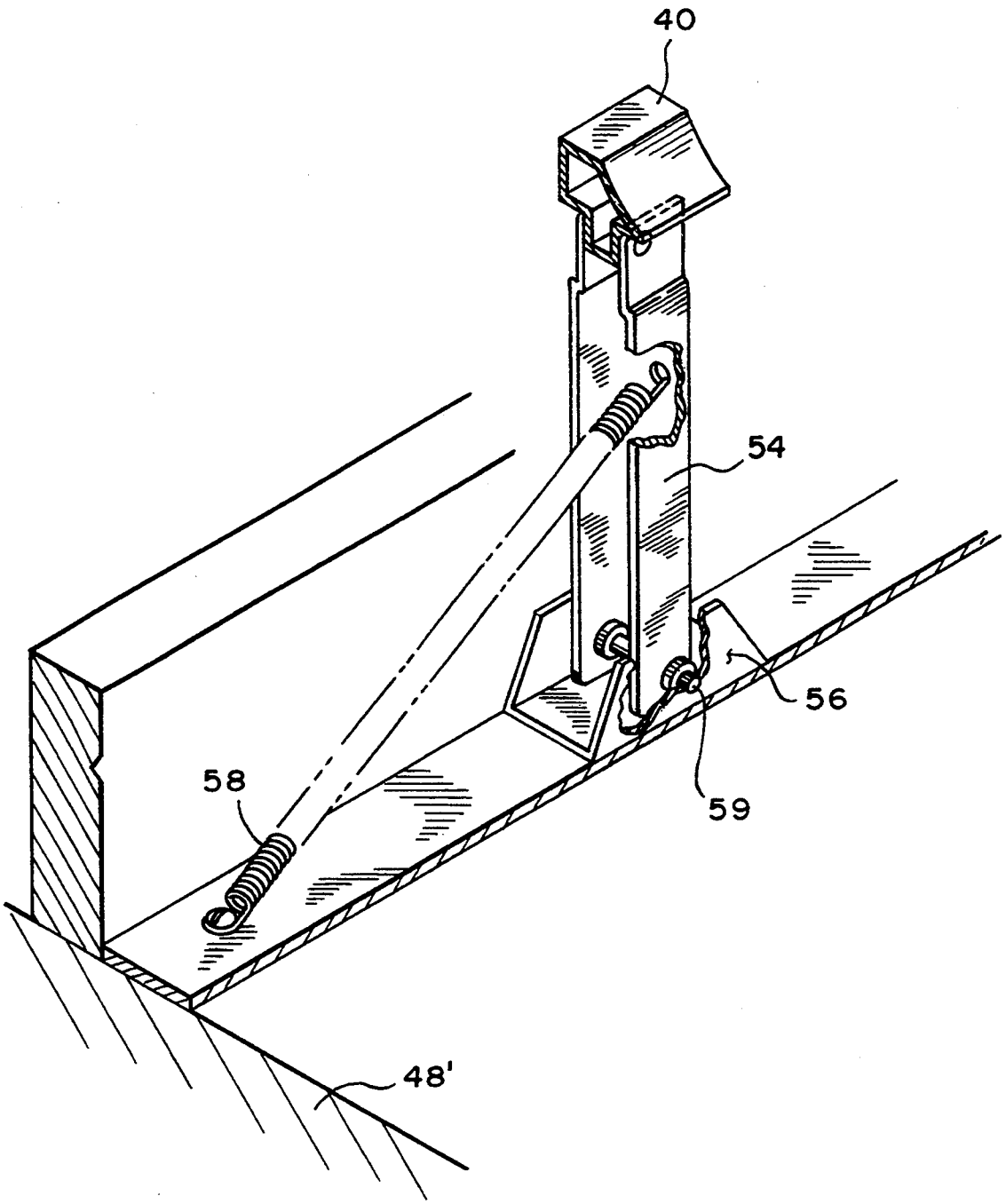
FIG. 7 is a perspective view of a channel member, hinge assembly and spring in accordance with a preferred embodiment of the invention but with the bumper shown in its extended position.

In a preferred embodiment of the invention, the crank arm 54 defines a channel member as illustrated more clearly in FIG. 7. The channel member or crank arm 54 is pivotably mounted at one end to mounting member 56 which is attached in a conventional manner to a suitable base. The second end of the channel member is pivotably mounted to the downwardly extending projection 46. As the portion 40 or bumper is moved upwardly, a lower forwardly extending portion of the channel member engages the base member 56. This "stop" mechanism prevents further rotation of the crank arm 54 and limits rotation to about 90° or slightly beyond 90°.

While the invention has been described in connection with one of its preferred embodiments, it should be understood that changes and modifications may be made without departing from the scope of the appended claims.

What is claimed is:

1. A bowling alley bumper system comprising a bowling alley having two sides, a longitudinally extending lane and an upper surface thereon, said lane having a foul line at one end and a pin deck at an opposite end thereof, a pair of elongated concave gutters extending along and substantially abutting either side of said lane between the ends thereof for receiving a bowling ball which falls off of said lane, and a base for supporting said lane and said gutter, movable bumper means including a bumper, a crank arm and a pair of swivel connecting elements pivotably connecting one end of said crank arm to said base and an opposite end of said crank arm to said bumper for preventing a bowling ball from falling into said gutter when in an extended position and for permitting a bowling ball to fall into said gutter when in a retracted position, said movable bumper means including spring biasing means for holding said movable bumper means in its extended and retracted positions and for biasing said movable bumper into and toward its extended position when it is moved out of its retracted position, said spring biasing means comprising a coil spring attached at one end thereof to said base and at an opposite end thereof to said crank arm and a pivot member disposed between the ends of said spring to form an over-center spring assembly to retain said bumper in its retracted position when said spring is in an over-center position with respect to said pivot member and to bias said bumper upwardly so that said bumper pops up into its extended position when said spring is moved out of its over-center position.

2. A bowling alley bumper system according to claim 1 in which each of said gutters define first and second separate longitudinally extending portions with each of said portions having a major axis parallel to the axis of said lane, extending and retracting means for moving one of said portions of each of said gutters upwardly into an extended position to thereby form one of said bumper means.

3. A bowling alley bumper system according to claim 2 in which each of said portions defines a segment with a downwardly extending projection adjacent one of said sides of said alleys, extending and retracting means for moving said one of said portions of each of said gutters upwardly along an arc in an XZ plane with little or no lateral movement along a Y axis into an extended position.

4. A bowling alley bumper system according to claim 3 in which said extending and retracting means moves through an are of about 90°.

5. A bowling alley bumper system according to claim 4 in which said crank arm defines a channel shaped cross section and in which said crank arm limits the rotation of said member to about 90°.

6. A bowling alley bumper system according to claim 4 in which said crank arm includes an engaging section which engages a portion of said bumper means for preventing said bumper from moving beyond its extended position.

* * * * *